US006215235B1

(12) United States Patent
Osamura

(10) Patent No.: US 6,215,235 B1
(45) Date of Patent: Apr. 10, 2001

(54) SPARK PLUG HAVING A NOBLE METALLIC FIRING TIP BONDED TO AN ELECTRIC DISCHARGE ELECTRODE AND PREFERABLY INSTALLED IN INTERNAL COMBUSTION ENGINE

(75) Inventor: Hironori Osamura, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/247,827

(22) Filed: Feb. 11, 1999

(30) Foreign Application Priority Data

Feb. 16, 1998 (JP) ..... 10-051457

(51) Int. Cl.[7] ..... H01T 13/20
(52) U.S. Cl. ..... 313/141; 313/144; 445/7
(58) Field of Search ..... 313/141, 144; 445/7; 123/169 EL, 169 R

(56) References Cited

U.S. PATENT DOCUMENTS

| | | | | |
|---|---|---|---|---|
| 5,347,193 | | 9/1994 | Oshima et al. | 313/141 |
| 5,440,198 | * | 8/1995 | Oshima et al. | 313/141 |
| 5,461,210 | * | 10/1995 | Matsutani et al. | 445/7 |
| 6,078,129 | * | 6/2000 | Gotou et al. | 313/141 |

FOREIGN PATENT DOCUMENTS

| | | | | |
|---|---|---|---|---|
| 549368A2 | * | 3/1993 | (EP) | 131/141 |
| 803950A1 | | 10/1997 | (EP) . | |
| 3-176978 | | 7/1991 | (JP) . | |
| 5-159858 | | 6/1993 | (JP) . | |
| 6-36856 | | 2/1994 | (JP) . | |
| 10-41047 | | 2/1998 | (JP) . | |

OTHER PUBLICATIONS

Patent Abstracts of Japan, vol. 097, No. 005, May 30, 1997 & JP 09 007734 A (NGK Spark Plug Co. Ltd.), Jan. 10, 1997.

Patent Abstracts of Japan, vol. 097, No. 003, Mar. 31, 1997 & JP 08 298 178 A (NGK Spark Plug Co. Ltd.), Nov. 12, 1996.

* cited by examiner

*Primary Examiner*—Vip Patel
*Assistant Examiner*—Todd Reed Hopper
(74) *Attorney, Agent, or Firm*—Pillsbury Winthrop LLP

(57) ABSTRACT

A spark plug for an internal combustion engine comprises a noble metallic firing tip laser welded on the opposing surface of either a central electrode or a grounded electrode. A fused junction layer, formed between the noble metallic firing tip and the base electrode member, contains 40~70 wt % noble metallic firing tip component. The noble metallic firing tip has a non-fused portion axially extending by a length "L", where 0.2 mm ≦L≦0.7 mm. The fused junction layer axially extends by a length "M", where 0.2 mm ≦M≦0.7 mm. And, the relationship B≧1.3A is established when "A" represents the diameter of the noble metallic firing tip and "B" represents the diameter of a contact area at the boundary between the fused junction layer and the base electrode member, where 0.3 mm ≦A≦0.6 mm.

19 Claims, 9 Drawing Sheets

SPARK PLUG HAVING A NOBLE METALLIC FIRING TIP BONDED TO AN ELECTRIC DISCHARGE ELECTRODE AND PREFERABLY INSTALLED IN INTERNAL COMBUSTION ENGINE

BACKGROUND OF THE INVENTION

The present invention relates to a spark plug having a noble metallic firing tip provided on the surface of a central electrode or a grounded electrode, preferably installed in an internal combustion engine.

To extend the life and also to improve the performance of the spark plug for an internal combustion engine, a Pt alloy is preferably used as a material for the central electrode and/or the grounded electrode which cooperatively cause an electrical discharge.

In view of the recent trends toward the exhaust gas purification and lean burn techniques, it is desirable to reduce the diameter and also to enlarge the axial length of each electrode to improve the ignitability.

However, the Ni alloy spark electrodes, when reduced in diameter and enlarged in axial length, are subjected to exhaustion or wear in use. This will undesirably increase the spark gap between the Ni alloy spark electrodes, worsening the ignitability significantly.

To solve this problem, it is effective to provide a noble metallic firing tip on at least one confronting surface of the central electrode and the grounded electrode.

The bonding of the noble metallic firing tip to the electrode member is, for example, performed by the laser welding.

Unexamined Japanese Patent Application No. Kokai 6-36856 discloses a spark plug fabricated by using the laser-welding.

According to this prior art, the spark plug comprises a base electrode member having a smaller-diameter rod portion. A noble metallic firing tip, identical in diameter with the smaller-diameter rod portion, is bonded to the top of the smaller-diameter rod portion by the laser welding. A fused junction layer, in which the base electrode member and the noble metallic firing tip are fused together and then hardened, is formed between the base electrode member and the noble metallic firing tip.

FIGS. 11A, 11B and 11C show the detailed bonding steps of the noble metallic firing tip to the electrode member. First, a noble metallic firing tip 3 is placed on a top surface 911 of a smaller-diameter rod portion 91 of a base electrode member 9 as shown in FIGS. 11A and 11B. Then, the noble metallic firing tip 3 and the base electrode member 9 are bonded by using a laser beam 5 applied entirely along their circumferential boundary 93 as shown in FIG. 11C. Through the laser welding performed in this manner, the noble metallic firing tip 3 and the base electrode member 9 are fused together. And then, after finishing the laser welding, the fused portion is hardened to leave a fused junction layer 4 having a wedge shape.

In this laser welding, the base electrode member 9 is subjected to the scattering of the base metal due to the sputtering. Accordingly, as shown in FIG. 11C, a necked portion 49 having a reduced diameter is formed near the bonding boundary of the base electrode member.

The above-described conventional spark plug has the following problems.

From the view point of the global environmental protection, the recent restrictions to the exhaust gas emission and to the fuel economy have been becoming severe. To respond to such severe requirements, the spark plugs must be highly advanced in performances to realize the lean burn or other advanced techniques. To this end, the noble metallic firing tip, provided at the electric discharge portion, needs to be small in diameter.

Under such circumstances, the phenomenon that the laser welding substantially reduces the radial size of the base electrode member 9 becomes a problem not negligible when the noble metallic firing tip 3 and the small-diameter rod portion 91 of the base electrode member 9 need to be downsized in their diameters. The following are the problems arising from the radial size reduction of the base electrode member 9 by the laser beam 5.

More specifically, the spark plug equipped in an internal combustion engine will be subjected to high temperatures when the internal combustion engine is driven at high speeds. In this case, the noble metallic firing tip 3 cannot smoothly transfer the received heat to the base electrode member 9 due to a narrowed bonding portion of the base electrode member 9 adjacent to the noble metallic firing tip 3. Accordingly, a remarkable temperature increase occurs in the noble metallic firing tip 3. This will induce the extraordinary wear at the electric discharge portion.

Furthermore, the small-diameter rod portion 91 is so weak against high temperatures that it thermally deforms and causes the noble metallic firing tip 3 to fall or drop out of the small-diameter rod portion 91.

SUMMARY OF THE INVENTION

In view of the above-described conventional problems, the present invention has an object to provide a spark plug which has an excellent strength in a fused junction layer formed at the boundary between the small-diameter noble metallic firing tip and the base electrode member, thereby assuring high performance and long life of the spark plug so as to be preferably applicable to internal combustion engines.

The present invention provides a spark plug for an internal combustion engine, comprising an insulator having a through hole, a central electrode disposed at least at one end of the through hole, a housing holding the insulator, a grounded electrode provided on the housing in a confronting relationship with the central electrode to form a spark gap between the central electrode and the grounded electrode, and a noble metallic firing tip bonded on at least one confronting surface of the central electrode and the grounded electrode, the noble metallic firing tip being laser welded to a base electrode member of the confronting surface so as to form a fused junction layer at the boundary between the noble metallic firing tip and the base electrode member in which the noble metallic firing tip and the base electrode member are fused together and then hardened, wherein the fused junction layer contains 40~70 wt % noble metallic firing tip component, the noble metallic firing tip has a non-fused portion axially extending from its top to an upper end of the fused junction layer by an axial length "L", where 0.2 mm $\leqq L \leqq 0.7$ mm, the fused junction layer axially extends from the upper end to its lower end by an axial length "M", where 0.2 mm $\leqq M \leqq 0.7$ mm, and the relationship $B \geqq 1.3A$ is established when "A" represents the diameter of the noble metallic firing tip and "B" represents the diameter of a contact area at the boundary between the fused junction layer and the base electrode member, where 0.3 mm ≦A≦0.6 mm.

The characteristic features of the present invention reside in that:

the relationship B≧1.3A is established when "A" represents the diameter of the noble metallic firing tip and "B" represents the diameter of the contact area at the boundary between the fused junction layer and the base electrode member, where 0.3 mm ≦A≦0.6 mm;

the fused junction layer contains 40~70 wt % noble metallic firing tip component; and the lengths "L", "M" and "A" are respectively defined as described above.

First, according to the present invention, B≧1.3A must be established in the relationship between the diameter "A" of the noble metallic firing tip and the diameter "B" of the contact area at the boundary between the fused junction layer and the base electrode member. In this case, the diameter "B" is represented by the diameter of a circle formed when the above-defined contact area is projected in the axial direction of the noble metallic firing tip.

If B is smaller than 1.3A (i.e., B<1.3A), the noble metallic firing tip will fall or drop out of the base electrode member due to thermal deformation of the base electrode member.

To improve the performance of the spark plug, it is necessary to downsize the noble metallic firing tip to have the diameter "A" in the range of 0.3 mm to 0.6 mm.

When the diameter "A" of the noble metallic firing tip is in the range of 0.3 mm to 0.6 mm, the fused junction layer has a corresponding small diameter. This is not desirable in that the noble metallic firing tip cannot smoothly release the received heat to the base electrode member.

Thus, the fused junction layer with a lower melting point is subjected to high temperatures. The bonding strength is so reduced that the noble metallic firing tip will fall or drop out of the base electrode member due to thermal deformation of the base electrode member.

Establishing the above-described relationship B≧1.3A is mandatorily necessary to solve these problems.

Second, according to the present invention, the fused junction layer must contain 40~70 wt % noble metallic firing tip component. If the noble metallic firing tip component is less than 40 wt %, the fused junction layer will have a poor endurance strength due to the thermal stress. In the same manner, if the noble metallic firing tip component is larger than 70 wt %, the fused junction layer will have a poor endurance strength due to the thermal stress.

In short, the fused junction layer and the non-fused portions of the noble metallic firing tip and the base electrode member are all subjected to high temperatures when the spark plug is in use. A significant amount of thermal stress acts in the bonding boundaries therebetween due to the difference of material components.

To suppress the thermal stress, it is necessary to reduce the thermal expansion difference between the fused junction layer and the non-fused portion of the noble metallic firing tip as well as between the fused junction layer and the non-fused portion of the base electrode member.

Thus, the fused junction layer containing 40~70 wt % noble metallic firing tip component is mandatorily necessary to effectively reduce the thermal expansion differences acting at the bonding boundaries and maintain the bonding strengths at satisfactory levels.

In the above-defined range, the noble metallic firing tip component is shifted toward a larger value in the weight percentage (wt %). This is because, when the spark plug is installed in an internal combustion engine, the noble metallic firing tip is exposed to a severe thermal environment compared with the base electrode member. In other words, it is effective to reduce the component difference at the higher-temperature side to suppress the thermal stress which proportionally increases with rising temperature.

The axial length "L" of the non-fused portion of the noble metallic firing tip is in the range of 0.2 mm ≦L≦0.7 mm. In this case, the boundary between the noble metallic firing tip and the fused junction layer is defined by the uppermost position of the fused junction layer closest to the top of the noble metallic firing tip.

If the length "L" is less than 0.2 mm, an electric discharge will occur from the fused junction layer. This will worsen the wear and abrasion resistance.

If the length "L"is larger than 0.7 mm, not only the heat radiation but the material strength will be worsened. This will lead to the fusion or breaking damage of the firing tip.

Namely, when the noble metallic firing tip wears during operation of the spark plug, an electric discharge occurs from the fused junction layer. According to the present invention, the fused junction layer is an alloy of the noble metallic firing tip and the base electrode member which is weak against the wear. Hence, the life of the spark plug is shortened due to the weakness of the fused junction layer.

To prevent this problem, the length "L" of the non-fused portion of the noble metallic firing tip must be equal to or larger than 0.2 mm so that no electric discharge can occur from the fused junction layer even when the noble metallic firing tip is worn a little.

On the other hand, when the length "L" is less than 0.2 mm, the heat generated by spark discharge will not be smoothly transferred from the noble metallic firing tip to the base electrode member. Furthermore, the strength in the radial direction deteriorates when the noble metallic firing tip has a small diameter. This will lead to fusion or breaking damage of the noble metallic firing tip.

Thus, to assure the sufficient life of the spark plug, it is necessary to set the length "L" of the non-fused portion of the noble metallic firing tip in the above-defined range.

The length "M" of the fused junction layer is in the range of 0.2 mm ≦M≦0.7 mm. In this case, the length "M" is an axial length from an upper end to a lower end. The upper end is the uppermost position of the fused junction layer closest to the top of the noble metallic firing tip, while the lower end is the lowermost position of the fused junction layer closest to the base electrode member.

When the length "M" is less than 0.2 mm, it is difficult to increase the laser beam energy. The depth of the fused junction layer is insufficient. The non-fused portion may remain at the boundary between the noble metallic firing tip and the base electrode member. The bonding strength will be insufficient.

On the other hand, when the length "M" is larger than 0.7 mm, the cost increases due to the elongated length of the noble metallic firing tip.

The diameter "A" of the noble metallic firing tip is in the range of 0.3 mm ≦A≦0.6 mm. When the diameter "A" is less than 0.3 mm, the noble metallic firing tip will wear heavily due to concentrated spark discharges. On the other hand, when the diameter "A" is larger than 0.6 mm, the ignitability is worsened.

Namely, the ignitability is improved when the diameter "A" of the noble metallic firing tip is small. However, when the diameter "A" is too much small, the noble metallic firing tip wears heavily due to concentrated spark discharges.

Hence, to extend the life of the spark plug, it is necessary to assure the ignitability and the wear resistance of the noble metallic firing tip. Thus, it is necessary to set the diameter "A" of the noble metallic firing tip in the above-defined range.

The present invention has the following functions and effects.

The noble metallic firing tip, the base electrode member, and the fused junction layer are configured into a shape satisfying the above-defined relationships. The fused junction layer has the above-defined component ratio. Hence, it becomes possible to prevent the bonding region from being thinned during the bonding operation of the noble metallic firing tip by the laser welding. Furthermore, it becomes possible to maintain the bonding strength endurable against thermal stresses. Moreover, it becomes possible to maintain better ignitability and wear resistance.

Accordingly, the present invention provides a spark plug which has an excellent strength in the fused junction layer formed at the boundary between the small-diameter noble metallic firing tip and the base electrode member, thereby assuring high performance and long life of the spark plug preferably applicable to internal combustion engines.

Furthermore, according to the present invention, it is preferable that the noble metallic firing tip comprises at least one component selected from the group consisting of Pt, Ir, Pd, Ru, Rh, and Os.

This is advantageous in that the noble metallic firing tip can improve the resistance to oxidation in the high-temperature environment. Thus, it becomes possible to effectively suppress the wear of the noble metallic firing tip and extend the life.

Furthermore, according to the present invention, it is preferable that the noble metallic firing tip comprises an additive selected from the group consisting of Ni, W, Si, $Y_2O_3$, $ZrO_2$, $Al_2O_3$.

The noble metallic firing tip can improve the resistance to oxidation. The life of the noble metallic firing tip can be extended.

Furthermore, according to the present invention, it is preferable that the base electrode member is a heat-resistant alloy containing Ni with additives of Fe and Cr.

This is advantageous in that the base electrode member can improve the heat resistance. Thus, it becomes possible to extend the life of the spark plug which is used in the thermally severe environment.

Furthermore, according to the present invention, it is preferable that the noble metallic firing tip is formed by extending an ingot of a noble metallic material into a wire through a hot forging, and cutting the obtained wire into a piece of the noble metallic firing tip having a predetermined length.

The noble metallic firing tip, fabricated in the above-described processes, has uniform distribution in blowholes and material components and is therefore free from the organic or structural roughening. Thus, it becomes possible to easily obtain a noble metallic firing tip excellent in the wear resistance. Namely, the life of the spark plug can be extended.

Furthermore, according to the present invention, it is preferable that the fused junction layer has a trapezoidal cross section. This is advantageous in that the bonding strength between the noble metallic firing tip and the base electrode member can be improved.

Furthermore, according to the present invention, it is preferable that the fused junction layer is formed by entirely fusing the boundary between the noble metallic firing tip and the base electrode member without leaving a non-fused boundary. This arrangement is effective to assure a sufficient bonding strength of the fused junction layer.

Furthermore, according to the present invention, it is preferable that the fused junction layer has a minimum axial length "T" equal to or larger than 0.05 mm at the axial center of the noble metallic firing tip. The fused junction layer is formed at an end portion of the noble metallic firing tip.

Another aspect of the present invention provides a method for manufacturing a spark plug of an internal combustion engine, comprising the steps of:

disposing a Ni-containing central electrode at least at one end of a through hole of an insulator held in a housing;

providing a Ni-containing grounded electrode on the housing in a confronting relationship with the central electrode to form a spark gap between the central electrode and the grounded electrode;

bonding a noble metallic firing tip on at least one confronting surface of the central electrode and the grounded electrode by applying a laser beam to a boundary between the noble metallic firing tip and a base electrode member of the confronting surface, said noble metallic firing tip having a diameter "A" in the range from 0.3 mm to 0.6 mm; and hardening the laser welded portion so as to form a fused junction layer at the boundary between the noble metallic firing tip and the base electrode member, wherein the fused junction layer contains 40~70 wt % noble metallic firing tip component, the noble metallic firing tip has a non-fused portion axially extending from its top to an upper end of the fused junction layer by an axial length "L", where 0.2 mm $\leqq L \leqq 0.7$ mm, the fused junction layer axially extends from the upper end to its lower end by an axial length "M", where 0.2 mm $\leqq M \leqq 0.7$ mm, and the relationship $B \geqq 1.3A$ is established where "B" represents the maximum width of a contact area which is formed by projecting the boundary between the fused junction layer and the base electrode member in an axial direction of the noble metallic firing tip.

In the bonding step, the noble metallic firing tip is put on the base electrode member or temporarily fixed by resistance welding. And then, the laser beam is applied to the boundary between the noble metallic firing tip and the base electrode member.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENT

Figure 1:
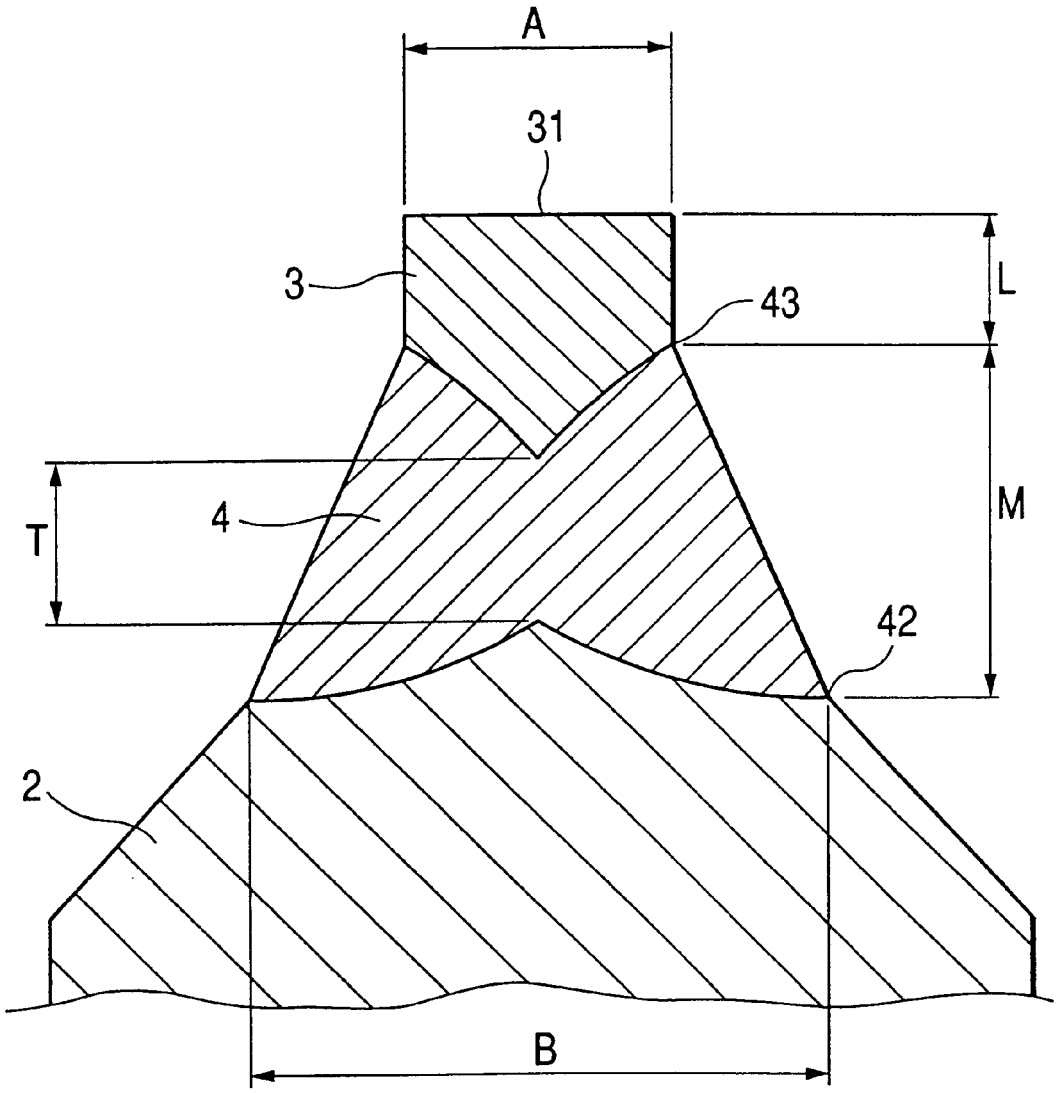
FIG. 1 is a cross-sectional view showing a base electrode member, a noble metallic firing tip, and a fused junction layer of a spark plug in accordance with a preferred embodiment of the present invention.
Figure 2:
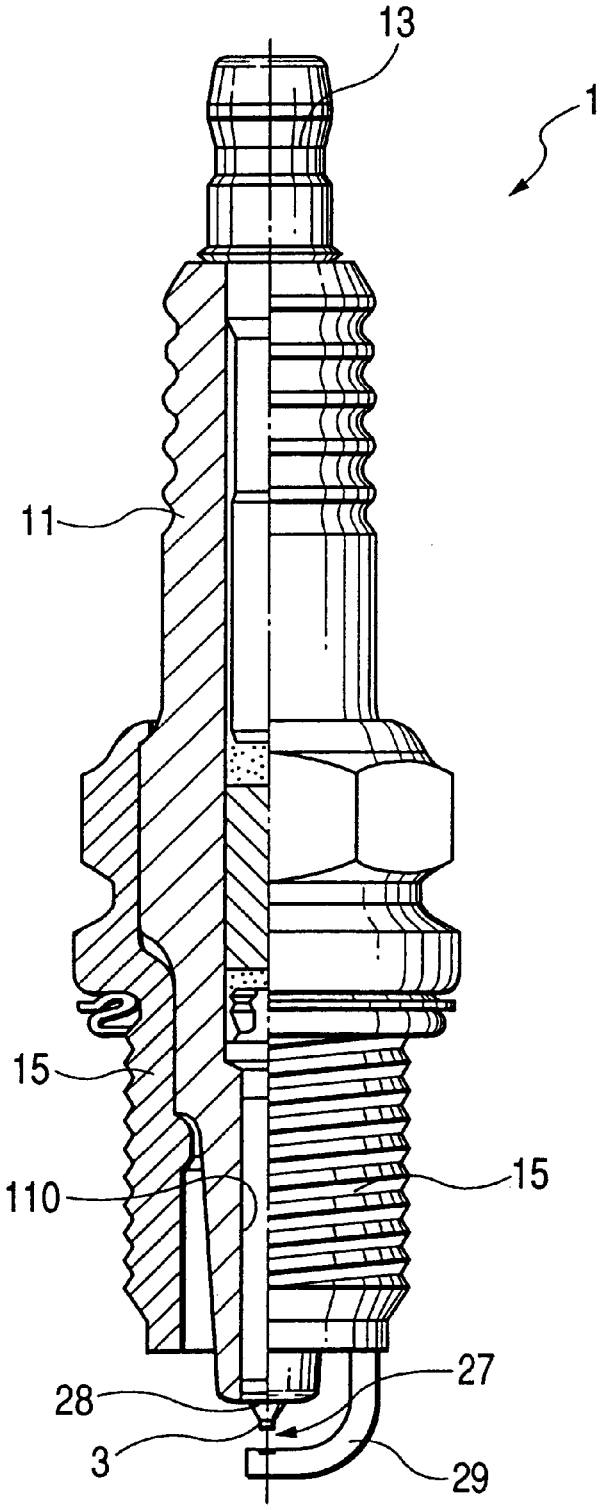
FIG. 2 is a partly-sectional front view showing the overall arrangement of the spark plug in accordance with the preferred embodiment of the present invention.

FIGS. 1 through 3 show a spark plug applicable to an internal combustion engine in accordance with a preferred embodiment of the present invention.

As shown in FIG. 2, a spark plug 1 comprises an insulator 11 having a through hole 110, a central electrode 28 disposed at least at one end of the through hole 110, a housing 15 holding the insulator 11, and a grounded electrode 29 provided on the housing 15 in a confronting relationship with the central electrode 28 to form a spark gap 27 between the central electrode 28 and the grounded electrode 29.

According to this embodiment, a noble metallic firing tip 3 is bonded by the laser welding on the surface of the central electrode 28 confronting with the grounded electrode 29.

Furthermore, as shown in FIG. 1, the noble metallic firing tip 3 is laser welded to a base electrode member 2 of the central electrode 28 so as to form a trapezoidal fused junction layer 4 at the boundary between the noble metallic firing tip 3 and the base electrode member 2 in which the noble metallic firing tip 3 and the base electrode member 2 are fused together and then hardened.

The fused junction layer 4 contains 40~70wt % noble metallic firing tip component.

The noble metallic firing tip 3 has a non-fused portion axially extending from the top 31 to an upper end 43 of the fused junction layer 4 by a length "L", where 0.2 mm $\leqq L \leqq$0.7 mm.

The fused junction layer 4 axially extends from the upper end 43 to its lower end 42 by a length "M", where 0.2 mm $\leqq M \leqq$0.7 mm.

Furthermore, the relationship $B \geqq 1.3A$ is established when "A" represents the diameter of the noble metallic firing tip 3 and "B" represents the diameter of a contact area at the boundary between the fused junction layer 4 and the base electrode member 2, where 0.3 mm $\leqq A \leqq$0.6 mm.

In FIG. 2, reference numeral 13 represents a connecting terminal for a high-voltage electric cord.

Next, the method for bonding the noble metallic firing tip 3 onto the base electrode member 2 will be explained with reference to FIGS. 3A to 3D.

According to this embodiment, the noble metallic firing tip 3 is an Ir-Rh alloy containing Ir with an additive of Rh.

The noble metallic firing tip 3 is formed by extending an ingot of the above-described noble metallic material into a wire through the hot forging, and cutting the obtained wire into a piece of the noble metallic firing tip having a predetermined length.

Figure 3A:
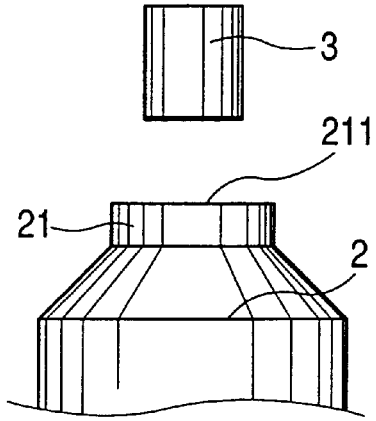
FIGS. 3A to 3D are views illustrating the method for bonding the noble metallic firing tip to the base electrode member in accordance with the preferred embodiment of the present invention.
Figure 3B:
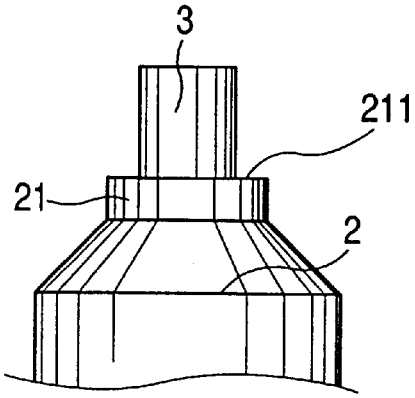
Figure 3C:
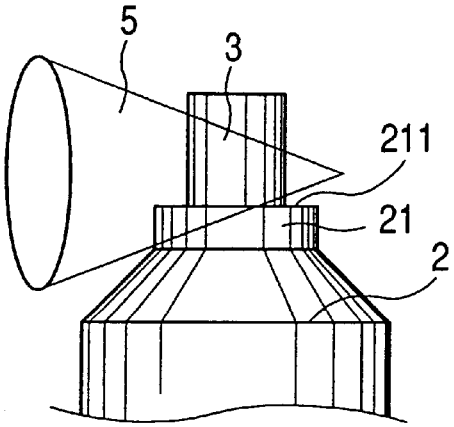

First, the noble metallic firing tip 3 is placed on a top surface 211 of a smaller-diameter rod portion 21 of the base electrode member 2, and is temporarily fixed by the resistance welding (refer to FIGS. 3A and 3B). The diameter of the smaller-diameter rod portion 21 is larger than that of the noble metallic firing tip 3. Next, the laser beam 5 is applied to the boundary between the noble metallic firing tip 3 and the smaller-diameter rod portion 21 of the base electrode member 2 (refer to FIG. 3C).

Under the irradiation of the laser beam 5, the base electrode member 2 is rotated and intermittently stopped at a total of ten angular spots spaced at equal angles in the circumferential direction of the base electrode member 2.

Through this laser welding, the boundary between the noble metallic firing tip 3 and the smaller-diameter rod portion 21 of the base electrode member 2 is fused by laser energy. After finishing the irradiation of the laser beam 5, the fused portion is left for a while for radiation of heat, thereby forming the fused junction layer 4 between the noble metallic firing tip 3 and the base electrode member 2. The fused junction layer 4 is constituted by an alloy wherein both the noble metallic firing tip 3 and the base electrode member 2 are fused and then hardened (refer to FIG. 3D).

The above-described spark plug has the following functions and effects.

The noble metallic firing tip 3, the base electrode member 2, and the fused junction layer 4 are configured into a shape satisfying the above-defined relationships. The fused junction layer 4 has the above-defined component ratio. Hence, it becomes possible to maintain the bonding strength so as to be endurable against thermal stresses in the bonded region between the noble metallic firing tip 3 and the base electrode member 2. Furthermore, it becomes possible to maintain better ignitability and wear resistance.

Figure 3D:
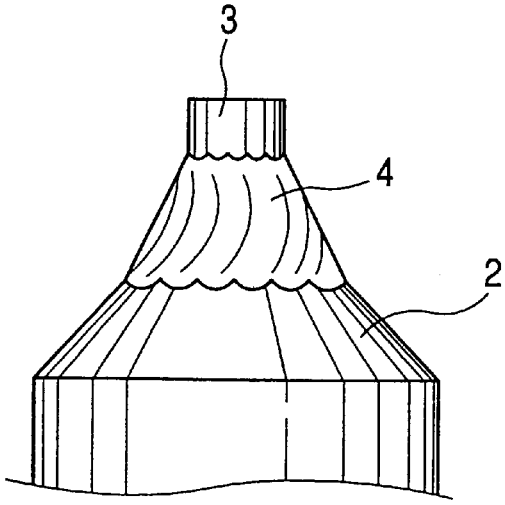

In general, as shown in FIG. 3D, the fused junction layer has wavy edges at its upper and lower ends because the laser beam 5 is applied to the predetermined spots angularly spaced in the circumferential direction as described above.

In this laser welding performed for bonding the noble metallic firing tip 3 to the base electrode member 2, the base electrode member 2 is subjected to the scattering of the base metal due to the sputtering. Accordingly, there is the possibility that a necked portion having a reduced diameter may be formed near the bonding boundary of the base electrode member 2.

However, according to the present invention, the diameter of the smaller-diameter rod portion 21 is larger than that of the noble metallic firing tip 3. The fused junction layer 4 remains in the trapezoidal shape in cross section after the welding operation is completed (refer to FIG. 1). Hence, it is possible to prevent the bonding region from being thinned undesirably. The noble metallic firing tip 3 can smoothly transfer the received heat to the base electrode member 2. The bonding strength can be maintained at satisfactory levels.

Furthermore, the noble metallic firing tip 3 is made of an Ir-Rh alloy containing Ir with an additive of Rh, and is formed by extending the noble metallic material into a wire through a hot forging and then cutting the obtained wire into a piece of the noble metallic firing tip as described above.

Hence, the noble metallic firing tip 3 can improve the resistance to the oxidation in the high-temperature environment. It becomes possible to effectively suppress the wear of the noble metallic firing tip. The noble metallic firing tip 3 has uniform distribution in blowholes and material components and is therefore free from the organic or structural roughening. Thus, it becomes possible to improve the wear resistance of the noble metallic firing tip 3. The life of the spark plug 1 can be extended.

Accordingly, the above-described embodiment provides the spark plug which has an excellent strength in the fused junction layer formed at the boundary between the small-diameter noble metallic firing tip and the base electrode member, thereby assuring high performance and long life of the spark plug so as to be preferably applicable to internal combustion engines.

Experiment 1

Figure 4:
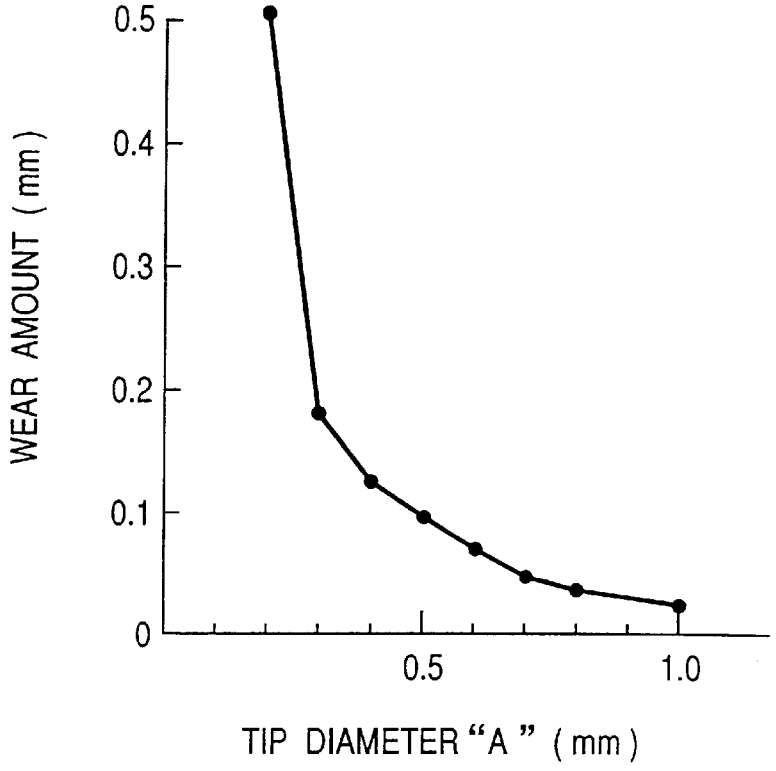
FIG. 4 is a graph showing the relationship between the wear amount and the diameter of the noble metallic firing tip obtained in experiment 1 of the present invention.

FIG. 4 shows the relationship between the wear resistance and the diameter "A" of the noble metallic firing tip obtained through an experiment conducted by the inventor. The noble metallic firing tip 3 used in this experiment is bonded on the surface of the central electrode 28 (refer to FIG. 2).

The noble metallic firing tip 3 is made of an Ir-10 wt % Rh material. The diameter "A" of each experimented noble metallic firing tip 3 ranges from 0.2 mm to 1.0 mm. The length is fixed to 1.0 mm.

Furthermore, a disc-shaped firing tip is bonded on the surface of the grounded electrode 29 by the laser welding. The disc-shaped firing tip is made of the same material as that of the noble metallic firing tip 3, and has the size of 1.0 mm in the diameter "A" and 0.3 mm in the length.

Each tested spark plug was installed in a 4-cycle, 6-cylinder, 2,000 cc internal combustion engine. The engine was driven at the full load of 5,600 rpm for 200 hours to measure the enlarged amount of the spark gap 27. Based on the measured variation in the spark gap 27, the wear amount of the noble metallic firing tip 3 on the central electrode 28 was obtained.

The above-described test conditions are comparable with the practical conditions of the spark plug actually installed in an engine of an automotive vehicle which has run the distance of about 50,000 km in the ordinary driving conditions.

FIG. 4 shows the obtained test result.

As understood from FIG. 4, the spark discharge occurs in the concentrated manner when the diameter "A" of the noble metallic firing tip 3 is less than 0.3 mm. The wear amount is greatly increased in this region.

Accordingly, the test result demonstrates that a desirable range of the diameter "A" of the noble metallic firing tip is equal to or lager than 0.3 mm.

Experiment 2

Figure 5:
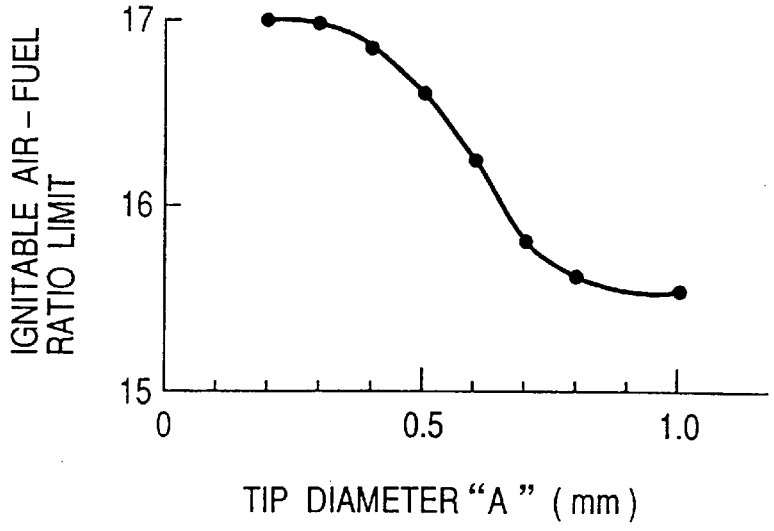
FIG. 5 is a graph showing the relationship between the ignitable air-fuel ratio limit and the diameter of the noble metallic firing tip obtained in experiment 2 of the present invention.

FIG. 5 shows a relationship between the ignitability and the diameter "A" of the noble metallic firing tip obtained through another experiment conducted by the inventor. The ignitability was evaluated by using a 4-cylinder, 1,600 cc internal combustion engine driven in an idling condition (at the engine speed of 650 rpm) where the ignitability needs to be highly reliable. The tested spark plugs were identical with those used in the above-described experiment 1.

In the judgement, the engine was continuously driven at the idling condition with a certain air-fuel ratio (i.e., a ratio of the air amount to the fuel amount) for two minutes. If one or no firing failure (detectable as HC spikes) is detected during two minutes, the engine was further continuously driven at the idling condition of an increased air-fuel ratio.

The driving test at the idling condition was repetitively done in this manner until at least two firing failures were detected during two minutes, thereby detecting an ignitable air-fuel ratio limit.

The above-described measurement for detecting the ignitable air-fuel ratio limit was repeated three times for each of tested spark plugs. When the spark plug has a large ignitable air-fuel ratio limit, an excellent ignitability is obtained even in a lean fuel mixture.

In the measurement, there is the possibility that judgement error or contingent firing failure may be erroneously detected as a firing failure. This is why the detection of only one firing failure during two minutes was neglected.

As understood from the measured result shown in FIG. 5, the ignitability was worsened with increasing diameter A" of the noble metallic firing tip. Especially, the ignitability was greatly worsened when the diameter A" exceeds 0.7 mm.

Accordingly, to assure sufficient ignitability, the diameter "A" of the noble metallic firing tip needs to be equal to or smaller than 0.6 mm.

Needless to say, worsening the ignitability is disadvantageous in view of present and/or expected future reinforcement in the fuel or exhaust gas regulations.

On the other hand, as described in the experiment 1, too much reducing the diameter "A" is not desirable in that the wear resistance is greatly worsened.

Although the discharge voltage reduces with decreasing diameter "A", the spark discharge occurs in the concentrated manner so as to promote the wear at the electrode.

In view of the foregoing, it is necessary to set the diameter "A" in the range of 0.3 mm $\leqq A \leqq 0.6$ mm to satisfy the requirements of both the wear resistance and the ignitability of the noble metallic firing tip.

Experiment 3

Table 1 shows a relationship between the heat resistance and the ratio "B/A" obtained through an experiment conducted by the inventor, where "B" represents the diameter of the fused junction layer 4 and "A" represents the diameter of the noble metallic firing tip 3.

Figure 6A:
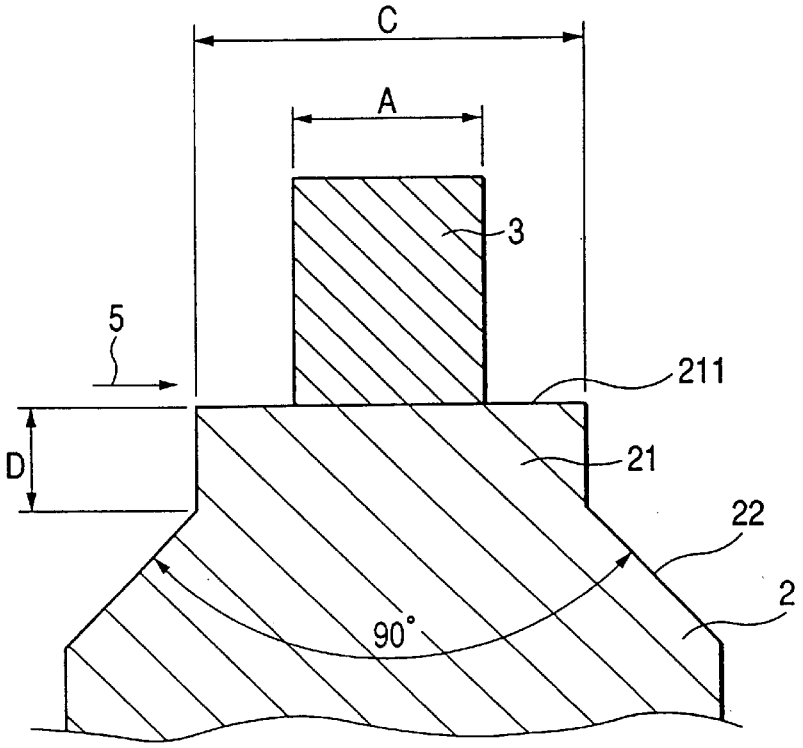
FIG. 6A is a cross-sectional view showing a condition before the noble metallic firing tip is bonded to the base electrode member.
Figure 6B:
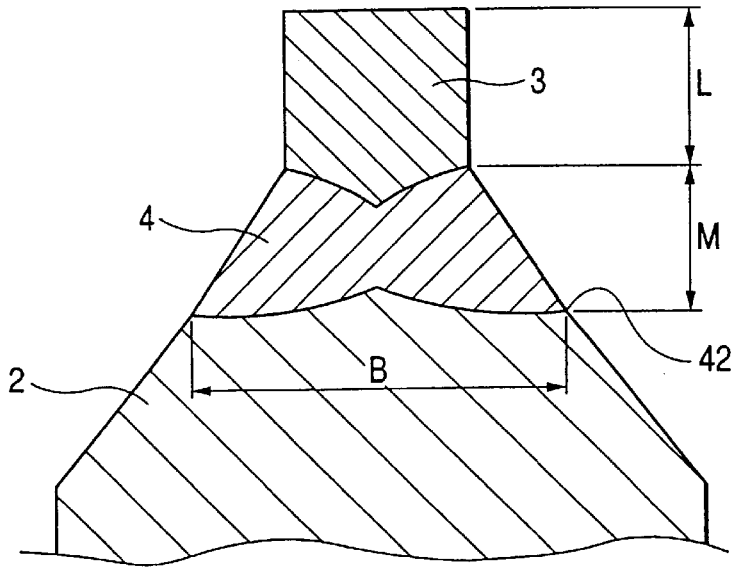
FIG. 6B is a cross-sectional view showing a condition after completing the bonding of the noble metallic firing tip to the base electrode member, in experiment 3 of the present invention.

FIGS. 6A and 6B are views showing the sample used in the evaluation.

In the experiment, various kinds of the base electrode members 2, each having the small-diameter rod portion 21 different in the diameter "C", were prepared. Various kinds of the noble metallic firing tips 3, different in the diameter "A", were welded on the surfaces of the prepared small-diameter rod portions 21 (Refer to FIG. 6A). Through the laser welding, the diameter "C" was equalized to the diameter "B" of the above-described contact area (refer to FIG. 6B).

More specifically, the diameter "A" was 0.3 mm or 0.6 mm. The length of the noble metallic firing tip 3 was 0.85 mm.

Furthermore, as shown in FIG. 6A, the small-diameter rod portions 21 has the axial length "D" of 0.15 mm.

Furthermore, the base electrode member 2 has a skirt 22 extending from the lower edge of the small-diameter rod portions 21. The spread angle of the skirt 22 is 90°.

In the bonding of the noble metallic firing tip 3 to the base electrode member 2, the laser beam 5 was applied to the position offset from the top surface 211 of the base electrode member 2 toward the noble metallic firing tip 3 by a distance 0.025 mm. The irradiation of the laser beam 5 was performed at a total of ten spots angularly spaced at equal intervals in the circumferential direction.

FIG. 6B shows the completed bonding structure with the fused junction layer 4, based on which the evaluation was done. More specifically, in the resultant spark plug, the length "L" of the non-fused portion of the noble metallic firing tip 3 was 0.7 mm and the length "M" of the fused junction layer 4 was 0.3 mm. Two test samples were used for each of the evaluation conditions.

The evaluation conditions were determined in the following manner. Each tested spark plug was installed in a 4-cycle, 6-cylinder, 2,000 cc internal combustion engine. The engine was driven at the full load of 6,000 rpm while advancing the ignition timing to measure the generation of the pre-ignition. Then, based on the result of the measurement, the ignition timing was held immediately before the critical point where the pre-ignition occurred. Then, the engine was driven for one hour to check the heat resistance of each tested spark plug.

Table 1 shows the tested result.

TABLE 1

| Diameter "B" | Diameter "A" 0.3 mm | Diameter "A" 0.6 mm |
|---|---|---|
| 1.5 A | ○○ | ○○ |
| 1.4 A | ○○ | ○○ |
| 1.3 A | ○○ | ○○ |
| 1.2 A | ΔΔ | Δ○ |
| 1.1 A | ΔΔ | ΔΔ |
| A | xx | Δx |

○---normal
Δ----inclination of noble metallic firing tip
x----drop out of noble metallic firing tip In the table 1, the expression A~1.5A indicates that the diameter "A" is 1.0~1.5 times the diameter "A".

Furthermore, in the table 1, every spark plug marked by ○ was normal.

Every spark plug marked by Δ demonstrated the inclined noble metallic firing tip due to thermal softening of the fused junction layer. Every spark plug marked by x caused the drop out of the noble metallic firing tip.

As understood well from the table 1, no abnormality was found in both cases of the diameter "A"=0.3 mm and 0.6 mm when B is equal to or larger than 1.3A. Accordingly, to assure the heat resistance of the spark plug, it is necessary to satisfy the relationship B≧1.3A.

Experiment 4

Figure 7:
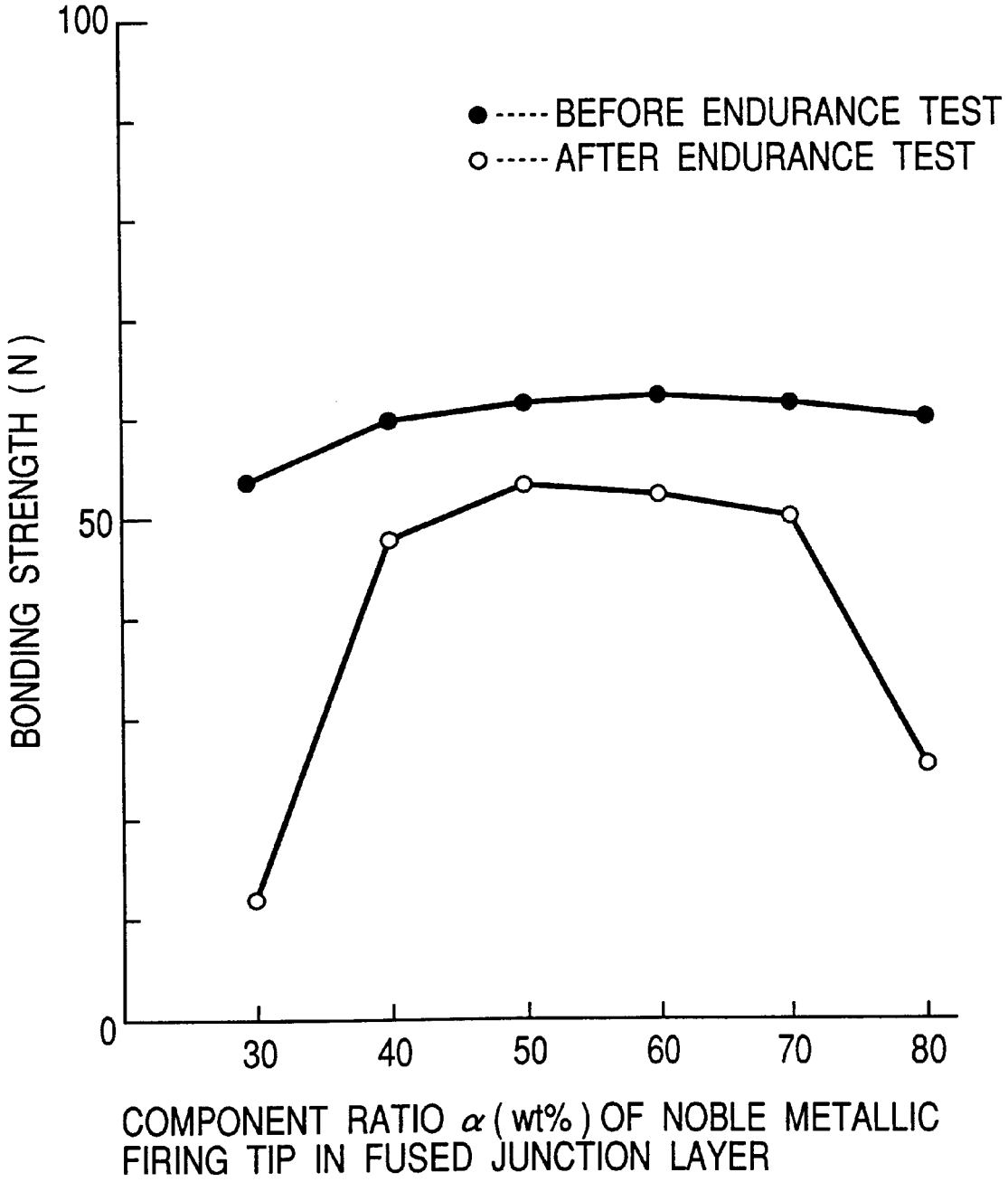
FIG. 7 is a graph showing the relationship between the bonding strength and the component ratio of the noble metallic firing tip contained in the fused junction layer obtained in experiment 4 of the present invention.

FIG. 7 is a graph showing the evaluation result in the bonding strength in relation to the component ratio of the noble metallic firing tip 3 in the fused junction layer 4.

The tested samples shown in FIGS. 6A and 6B were used in this evaluation, although the diameter "A" of the noble metallic firing tip 3 was 0.3 mm considering the severe thermal load. In the performed endurance test, the component ratio of the noble metallic firing tip 3 in the fused junction layer 4 was controlled by changing the irradiation position of the laser beam 5 at a plurality of altitudinal levels as shown in FIGS. 8A and 8B.

The length "M" of the fused junction layer 4 was 0.3 mm. The used laser energy was 7.5 J (joule). The laser irradiation was performed so that the fused portions overlapped with each other from opposed angles. The irradiation of the laser beam 5 was performed at a total of ten spots angularly spaced at equal intervals in the circumferential direction.

Figure 8A:
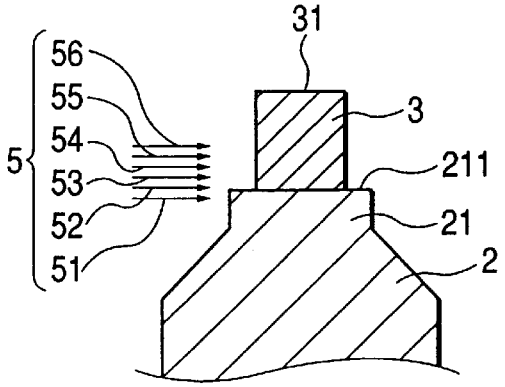
FIG. 8A is a cross-sectional view illustrating the method for forming each test sample used in an evaluation.
Figure 8B:
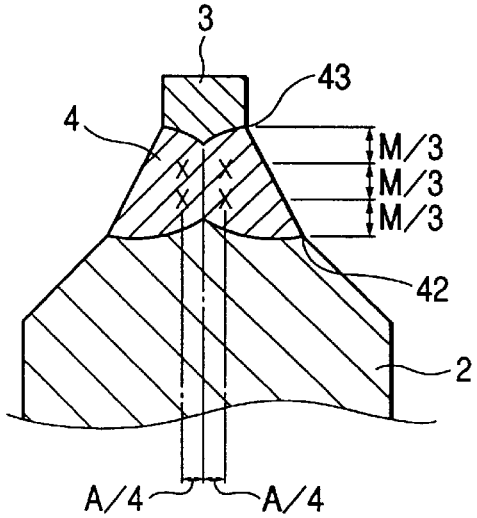
FIG. 8B is a view illustrating the measurement points for checking the component ratio in the fused junction layer, in the experiment 4.
Figure 9A:
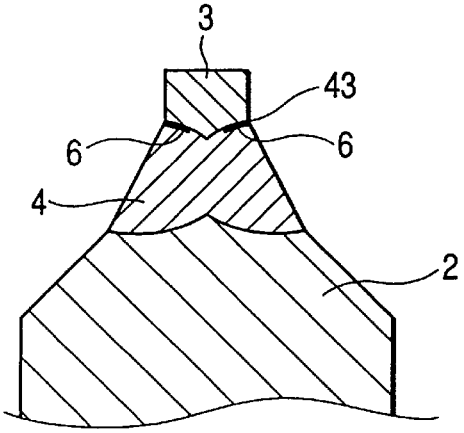
FIG. 9A is a cross-sectional view showing cracks appeared after the endurance test in the example of $\alpha$=30%.
Figure 9B:
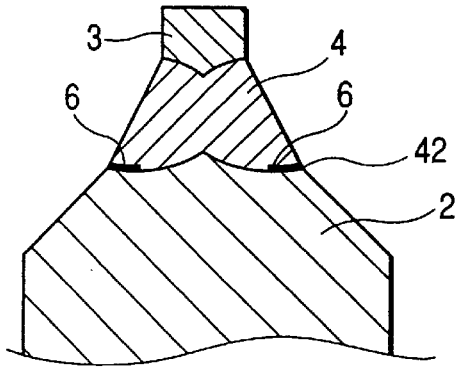
FIG. 9B is a cross-sectional view showing cracks appeared in the example of $\alpha$=80%, observed in the experiment 4.

First, the fused junction layer 4 was formed by applying the laser beam 5 at an altitudinal level 51 offset from the top surface 211 of the base electrode member 2 toward the base electrode member 2 by a distance 0.025 mm shown in FIG. 8A. In the sample obtained through this laser welding, the component ratio of the noble metallic firing tip in the fused junction layer 4 was 30% (i.e., $\alpha$=30%).

Then, the irradiation position was successively shifted upward to apply the laser beam 5 from the altitudinal levels 52, 53, 54, 55 and 56 which were vertical spaced at intervals of 0.025 mm. The laser level 52 was identical with the height of the top surface 211. Thus, other samples were obtained. The obtained test samples were differentiated in the component ratio $\alpha$ of the noble metallic firing tip 3 in the fused junction layer 4 (more specifically, $\alpha$=40, 50, 60, 70 and 80 wt %).

In this description, the component ratio $\alpha$ is defined as the weight percentage of the noble metallic firing tip 3 contained in the fused conjunction layer 4.

In the measurement of the component, the fused conjunction layer 4 was cut along a plane passing through its central axis. The cut surface was analyzed by the EPMA (the micro analysis based on the electron beam scanning).

The measurement was performed at a total of four measuring points on the surface of the fused junction layer 4 as shown by X in FIG. 8B, arrayed along two vertical lines offset by A/4 from the center of the fused junction layer 4 and two horizontal lines equally dividing the fused junction layer 4 extending from the upper end 43 to the lower end 42 at the intervals of M/3. An average of the measured data was used for the evaluation, although substantial no dispersion was recognized between the measured data because the fused junction layer 4 of each tested sample is uniform in alloy component.

In this manner, the endurance test was performed by using the spark plug 1 (shown in FIG. 2) having the noble metallic firing tip 3 bonded on the top of the central electrode 28 by the laser welding.

To check the durability of the tested spark plug, the spark plug was subjected to thermal shock for 100 hours in a 6-cylinder, 2,000 cc internal combustion engine which was driven in a predetermined cyclic mode, each cycle including one minute driving at the idling speed and one minute driving at the full load of 6,000 rpm.

FIG. 7 shows the measured data obtained in the endurance test, in the relationship between the bonding strength (N: Newton) of the fused junction layer 4 and the component ratio $\alpha$ of the noble metallic firing tip 3 in the fused junction layer 4.

The bonding strength is defined by the flexural strength at the fused junction layer 4. Having a larger flexural strength is effective to improve the connection between the noble metallic firing tip 3 and the base electrode member 2. In other words, it becomes possible to obtain a spark plug which is capable of smoothly relieving thermal stresses and is therefore excellent in durability.

As understood from FIG. 7, the tested samples were roughly constant in the flexural strength regardless of the difference of the component ratio a before starting the endurance test. However, it was found that the flexural strength greatly deteriorated after finishing the endurance test when the component ratio $\alpha$ was 30%. It was later confirmed through the detail inspection that tiny cracks 6 appeared due to thermal stresses along the boundary between the fused junction layer 4 and the noble metallic firing tip 3, i.e., along the upper end 43 of the fused junction layer 4.

Furthermore, it was also found that the flexural strength greatly deteriorated after finishing the endurance test when the component ratio $\alpha$ was 80%. It was also later confirmed through the detail inspection that tiny cracks 6 appeared due to thermal stresses along the boundary between the fused junction layer 4 and the base electrode member 2, i.e., along the lower end 42 of the fused junction layer 4.

In view of the foregoing, it is concluded that the component ratio a needs to be in the range from 40 wt % to 70 wt % to assure the satisfactory bonding strength for the noble metallic firing tip 3.

Furthermore, in the above-defined desirable range, the noble metallic firing tip component is shifted toward a larger value. This is because when the spark plug is installed in an internal combustion engine, the noble metallic firing tip 3 is exposed to a severe thermal environment compared with the base electrode member 2. In other words, it is effective to reduce the component difference at the higher-temperature side to suppress the thermal stress which proportionally increases with rising temperature.

Similarly, the endurance test was performed on the test samples of the noble metallic firing tips 3 having the diameter "A" of 0.6 mm. As a result, the preferable bonding strength was obtained when the component ratio $\alpha$ was in the range from 40 wt % to 70 wt % (i.e., 40 wt % $\leqq\alpha\leqq$70 wt %).

Figure 10:
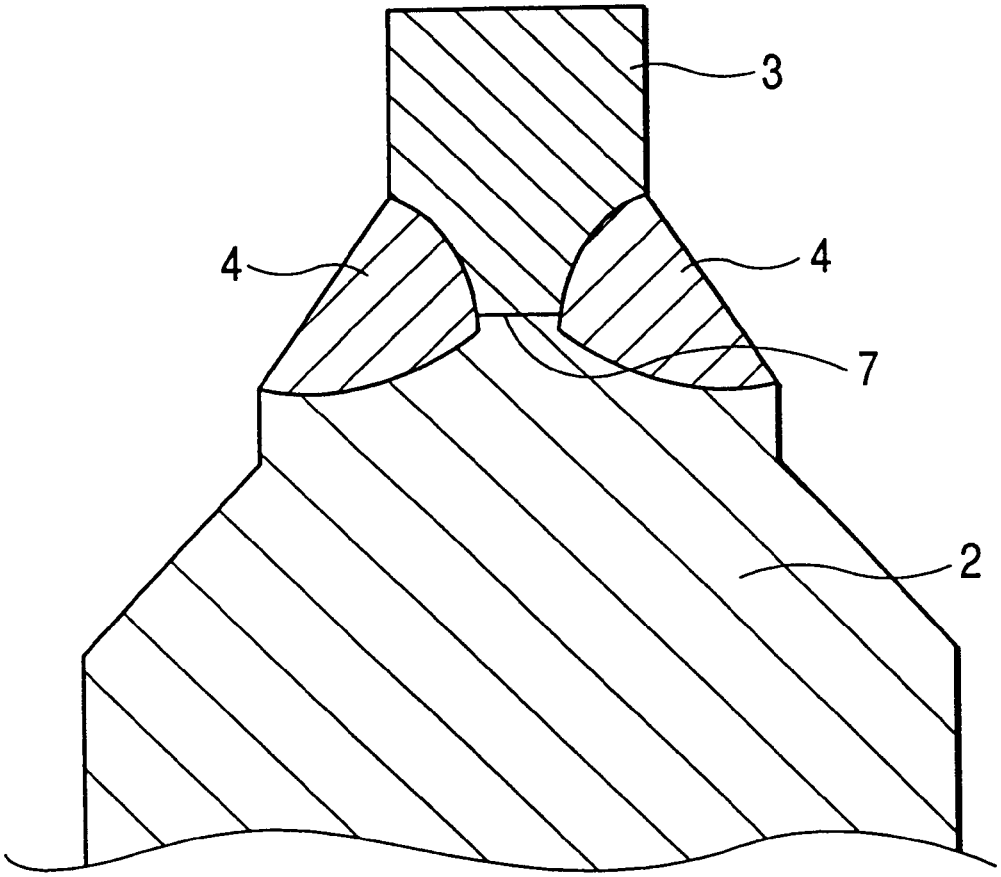
FIG. 10 is a cross-sectional view showing a non-fused boundary formed when the laser energy is low in the bonding of the noble metallic firing tip to the base electrode member, in the experiment 4.
Figure 11A:
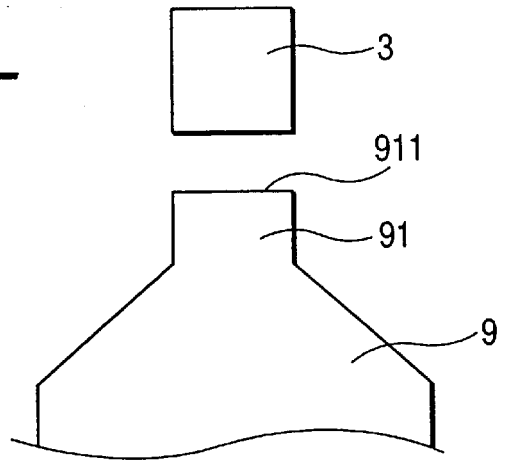
FIG. 11A PRIOR ART
FIGS. 11A to 11C are views illustrating a conventional method for bonding the noble metallic firing tip to the base electrode member.
Figure 11B:
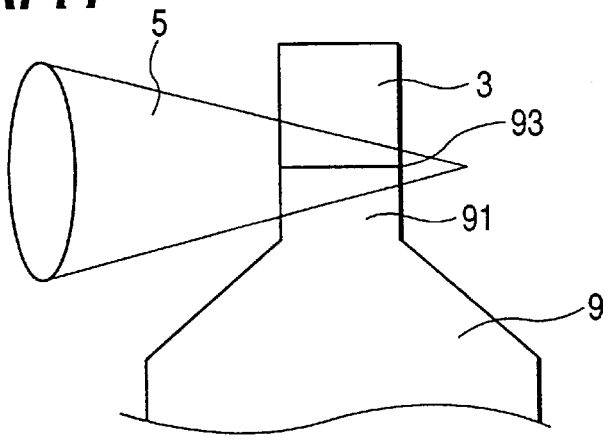
FIG. 11B PRIOR ART
Figure 11C:
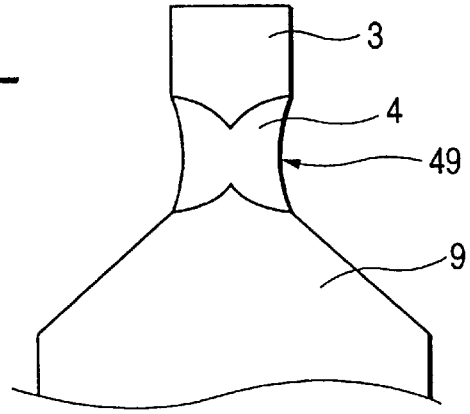
FIG. 11C PRIOR ART

For comparison, the laser energy was reduced to 6 J to form separate smaller fused layers 4 with a non-fused boundary 7 as shown in FIG. 10. In this case, it was confirmed that the flexural strength greatly deteriorated even in the range of 40 wt % $\leqq\alpha\leqq$70 wt %.

It is believed that each isolated fused junction layer 4 triggers the concentration of stress which induces the cracks 6. Hence, in the formation of the fused junction layer 4, it is necessary to eliminate the non-fused boundary 7. According to the experimental data, it is preferable that the fused junction layer 4 has a minimum axial length "T" equal to or larger than 0.05 mm at the axial center of the noble metallic firing tip 3 (refer to FIG. 1), so that the internal (thermal) stress can be sufficiently suppressed.

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A spark plug for an internal combustion engine, comprising an insulator having a through hole, a central electrode disposed at least at one end of said through hole, a housing holding said insulator, a grounded electrode provided on said housing in a confronting relationship with said central electrode to form a spark gap between said central electrode and said grounded electrode, and a noble metallic firing tip bonded on at least one confronting surface of said central electrode and said grounded electrode, said noble metallic firing tip being laser welded to a base electrode member of said confronting surface so as to form a fused junction layer at the boundary between said noble metallic firing tip and said base electrode member in which said noble metallic firing tip and said base electrode member are fused together and then hardened, wherein said fused junction layer contains 40~70 wt % noble metallic firing tip component, said noble metallic firing tip has a non-fused portion axially extending from its top to an upper end of said fused junction layer by an axial length "L", where 0.2 mm $\leqq L\leqq$0.7 mm, said fused junction layer axially extends from the upper end to its lower end by an axial length "M", where 0.2 mm $\leqq M\leqq$0.7 mm, and the relationship $B\geqq 1.3A$ is established when "A" represents the diameter of said noble metallic firing tip and "B" represents the diameter of a contact area at the boundary between said fused junction layer and said base electrode member, where 0.3 mm $\leqq A\leqq$0.6 mm.

2. The spark plug for an internal combustion engine in accordance with claim 1, wherein said noble metallic firing tip comprises at least one component selected from the group consisting of Pt, Ir, Pd, Ru, Rh, and Os.

3. The spark plug for an internal combustion engine in accordance with claim 1, wherein said noble metallic firing tip comprises an additive selected from the group consisting of Ni, W, Si, $Y_2O_3$, $ZrO_2$, $Al_2O^3$.

4. The spark plug for an internal combustion engine in accordance with claim 1, wherein said base electrode member is a heat-resistant alloy containing Ni with additives of Fe and Cr.

5. The spark plug for an internal combustion engine in accordance with claim 1, wherein said noble metallic firing tip is formed by extending an ingot of a noble metallic material into a wire through a hot forging, and cutting the obtained wire into a piece of the noble metallic firing tip having a predetermined length.

6. The spark plug for an internal combustion engine in accordance with claim 1, wherein said fused junction layer has a trapezoidal cross section.

7. The spark plug for an internal combustion engine in accordance with claim 1, wherein said fused junction layer is formed by entirely fusing the boundary between said noble metallic firing tip and said base electrode member without leaving a non-fused boundary.

8. The spark plug for an internal combustion engine in accordance with claim 1, wherein said fused junction layer has a minimum axial length "T" equal to or larger than 0.05 mm.

9. The spark plug for an internal combustion engine in accordance with claim 1, wherein said fused junction layer has a minimum axial length "T" at the axial center of said noble metallic firing tip, and said minimum length "T" is equal to or larger than 0.05 mm.

10. The spark plug for an internal combustion engine in accordance with claim 1, wherein said fused junction layer is formed at an end portion of said noble metallic firing tip.

11. A method for manufacturing a spark plug of an internal combustion engine, comprising the steps of:

disposing a Ni-containing central electrode at least at one end of a through hole of an insulator held in a housing;

providing a Ni-containing grounded electrode on said housing in a confronting relationship with said central electrode to form a spark gap between said central electrode and said grounded electrode;

bonding a noble metallic firing tip on at least one confronting surface of said central electrode and said grounded electrode by applying a laser beam to a boundary between said noble metallic firing tip and a base electrode member of said confronting surface, said noble metallic firing tip having a diameter "A" in the range from 0.3 mm to 0.6 mm; and hardening the laser welded portion so as to form a fused junction layer at the boundary between said noble metallic firing tip and said base electrode member, wherein said fused junction layer contains 40~70 wt % noble metallic firing tip component, said noble metallic firing tip has a non-fused portion axially extending from its top to an upper end of said fused junction layer by an axial length "L", where 0.2 mm $\leqq L \leqq 0.7$ mm, said fused junction layer axially extends from the upper end to its lower end by an axial length "M", where 0.2 mm $\leqq M \leqq 0.7$ mm, and the relationship $B \geqq 1.3A$ is established where "B" represents the maximum width of a contact area which is formed by projecting the boundary between said fused junction layer and said base electrode member in an axial direction of said noble metallic firing tip.

12. The manufacturing method in accordance with claim 11, wherein said bonding step is performed by putting said noble metallic firing tip on said base electrode member and then applying the laser beam to the boundary between said noble metallic firing tip and the base electrode member.

13. The manufacturing method in accordance with claim 11, wherein said bonding step is performed by temporarily fixing said noble metallic firing tip on said base electrode member by resistance welding and then applying the laser beam to the boundary between said noble metallic firing tip and the base electrode member.

14. The manufacturing method in accordance with claim 11, wherein said noble metallic firing tip comprises at least one component selected from the group consisting of Pt, Ir, Pd, Ru, Rh, and Os.

15. The manufacturing method in accordance with claim 11, wherein said noble metallic firing tip comprises an additive selected from the group consisting of Ni, W, Si, $Y_2O_3$, $ZrO_2$, $Al_2O_3$.

16. The manufacturing method in accordance with claim 11, wherein said base electrode member is a heat-resistant alloy containing Ni with additives of Fe and Cr.

17. The manufacturing method in accordance with claim 11, wherein said fused junction layer has a trapezoidal cross section.

18. The manufacturing method in accordance with claim 11, wherein said fused junction layer has a minimum axial length "T" equal to or larger than 0.05 mm.

19. The manufacturing method in accordance with claim 11, wherein said fused junction layer has a minimum axial length "T" at the center of said noble metallic firing tip, and said minimum axial length "T" is equal to or larger than 0.05 mm.

* * * * *